US007524219B2

(12) United States Patent
Torrangs et al.

(10) Patent No.: US 7,524,219 B2
(45) Date of Patent: Apr. 28, 2009

(54) STEERING CONTROL SYSTEM FOR A VESSEL, A VESSEL INCLUDING SUCH A STEERING CONTROL SYSTEM AND A METHOD FOR CONTROLLING A STEERING SYSTEM

(75) Inventors: Peter Torrangs, Mölnlycke (SE); Lennart Arvidsson, Kållered (SE)

(73) Assignees: CPAC Systems AB, Vastra Frolunda (SE); AB Volvo Penta, Gothenburg (SE)

( * ) Notice: Subject to any disclaimer, the term of this patent is extended or adjusted under 35 U.S.C. 154(b) by 0 days.

(21) Appl. No.: 12/160,611

(22) PCT Filed: Mar. 16, 2006

(86) PCT No.: PCT/SE2006/000341

§ 371 (c)(1),
(2), (4) Date: Jul. 11, 2008

(87) PCT Pub. No.: WO2007/105997

PCT Pub. Date: Sep. 20, 2007

(65) Prior Publication Data

US 2008/0299846 A1 Dec. 4, 2008

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS 4,431,422 A * 2/1984 Hall ..... 440/61 R
5,718,534 A * 2/1998 Neuling ..... 404/94
5,769,675 A 6/1998 Takahashi et al.
6,431,928 B1 * 8/2002 Aarnivuo ..... 440/58
2005/0282447 A1 12/2005 Okuyama

FOREIGN PATENT DOCUMENTS

WO 03093102 A1 11/2003
WO 2005102834 A1 11/2005
WO 2005102835 A1 11/2005

OTHER PUBLICATIONS

International Search Report for corresponding International Application PCT/SE2006/000341.

* cited by examiner

*Primary Examiner*—Stephen Avila
(74) *Attorney, Agent, or Firm*—WRB-IP LLP

(57) ABSTRACT

Steering control system for a vessel including at least two propulsion units pivotally arranged in relation to the hull of the vessel for generating a driving thrust of the vessel in a desired direction, wherein each propulsion unit is moveable within a working volume defined for each propulsion unit and wherein the working volume for neighboring propulsion units of the at least two propulsion units have a common space, the control system including at least two separate control units each controlling an associated propulsion unit, and a steering control instrument for determining the desired angular position of the propulsion units, where each of the separate control units are arranged for receiving a first input signal from the steering control instrument for determining the desired angular position of its associated propulsion unit and second input signal(s) originating from the other separate control units, associated with neighboring propulsion units, which second input signal(s) indicating the status of the their associated propulsion units.

5 Claims, 4 Drawing Sheets

STEERING CONTROL SYSTEM FOR A VESSEL, A VESSEL INCLUDING SUCH A STEERING CONTROL SYSTEM AND A METHOD FOR CONTROLLING A STEERING SYSTEM

BACKGROUND AND SUMMARY

The present invention relates to a steering control system. The invention particularly relates to a steering control system for a vessel including a plurality of propulsion units which are pivotally arranged in relation to the hull of the vessel in order to generate a driving thrust in a desired direction. The invention furthermore relates to a vessel including such a steering control system and a method for controlling a steering system of a vessel.

Vessels having a plurality of pivotally arranged propulsion units are widely known in the art. The position of the propulsion unit in relation to the hull of the vessel determines the direction of a driving thrust and thus steers the vessel in a desired direction. Pivotally arranged propulsion units of different types are known, such as for instance out board engines arranged in the stem of the vessel, out board drive units pivotally arranged in relation to the hull, and which put board drive units are powered from a non rotatably arranged power unit such as for instance of the type described in WO03093105 and azimuthal drive Units where the propulsion unit together with its power unit are pivotally arranged in relation to the vessel such as of the type described in U.S. Pat. No. 6,688,927. Small and middle size vessels, that is vessels having a length from 5-25 meters, frequently include a plurality of propulsion units for driving the vessel. These propulsion units are normally mechanically linked to each other in order to ensure safe steering of the propulsion units. An example of such a: conventional mechanically linked set of propulsion units is shown in FIG. 1. The steering control is normally performed by a single mechanical or hydraulical steering system physically connecting the propulsion unit with a steering wheel. With this type of steering system it is ensured that all propulsion units assume the same angular position relative to the hull. The latest development in steering systems for vessels have introduced steer by wire systems for small and middle sized vessels. In steer by wire system a steering control instrument, for instance a steering wheel or a joystick, is used for generating control signals which control signals are received by a control unit or units arranged for controlling the position of associated propulsion units, via use of actuators. The use of a steer by wire system enables individual positioning of each individual propulsion unit. By individually controlling the position of the propulsion units it is possible to steer the vessel in more elaborate steering patterns. It is for instance possible to allow the propulsion units to assume a slight "toe-in" position, that is the propulsion units on each side of the centre line of the hull are slightly directed toward the centre line in the backwards direction of the vessel in order to increase the driving stability of the vessel. It is possible to allow the propulsion units to assume a slight "toe-out" position, that is the propulsion units on each side of the centre line of the hull are slightly directed away from the centre line in the backwards direction of the vessel. It is furthermore also possible to allow the propulsion units to assume an "Ackermann" position when taking curves, that is the outer unit is controlled to have a slightly less sharp turn than an inner unit in a turn, which increases the efficiency in curve taking. Furthermore efficient docking can be created by directing the propulsion units in opposing direction making the vessel to move sideward, and finally the trim position of the vessel can be adjusted by controlling the relative position of the propulsion units. Individual control over the position of the propulsion units is therefore even more desirable for small and middle size vessels since for this type of vessels a freedom to control trim angle and roll angle in curve taking is of far more concerns for small and middle size vessels than for large vessels. Small and middle size vessels however have a limited space for available for mounting of propulsion units. This is particularly true for highly powered small vessels crafted for planning speeds. A small vessel of less than 40 feet may have a contact area with the water as small as 10% of the contact area at standstill when driving at planning speed. The water contact area is located at a limited area close to the centre line at the stern of the vessel. All propulsion units must be positioned within the area of water contact. This means that, especially in the case where it is desired to mount a plurality of propulsion units on small boats very limited space is available.

It is desirable to provide an improved control system which enables use of a plurality of individually steered propulsion units in a small restricted area. The invention is useful, according at least to an aspect thereof, in cases where a plurality of propulsion units are mounted in a restricted area such that each propulsion unit is moveable within a working volume defined for each propulsion unit and wherein the working volume for neighbouring propulsion units of said at least two propulsion units have a common space. The working volume is the volume in space which may be occupied by a propulsion unit as is pivoted for steering purposes within an allowed angular range around the pivot axle. The range may be 360°, but is normally within a smaller interval of ±45° in relation to the centre line of the hull. In the event two propulsion units each have a working volume which share a common space there will be a risk for a collision between the exterior parts of respective propulsion unit if both propulsion units are steered such to be positioned within the common space. In order to avoid collisions the steering of each propulsion unit must be coordinated with the steering of neighbouring propulsion units. The invention ensures that such control is feasible.

The invention is based on a steering control system including at least two separate control units each controlling an associated propulsion unit, and a steering control instrument for determining the desired angular position of the propulsion units. The steering control instrument may preferably be constituted by a steering wheel or a joy stick.

Each of said separate control units are arranged for receiving a first input signal from said steering control instrument for determining the desired angular position of its associated propulsion unit and second input signal(s) originating from the other separate control units, which second input signal(s) indicating the status of the their associated propulsion units. It is here obvious that a single second input signal is needed in the event two propulsion units are installed in the vessel and that further second input signals may be necessary in the event more than two propulsion units. Generally the number of second input signals necessary for a separate control unit is equivalent to the number of neighbouring propulsion units a propulsion unit associated with the separate control unit. The notation input signal(s) is intended to be interpreted as input signal or input signals depending on whether a single or a plurality of input signals are received.

Each propulsion unit is moveable within a working volume defined for each propulsion unit and wherein the working volume for neighbouring propulsion units of said at least two propulsion units have a common space With neighbouring propulsion unit is here intended propulsion units which share a common space. In the event three propulsion units are positioned side by side, the two external propulsion units have each a single neighbour while the propulsion unit in the middle has two neighbours. If the propulsion units are positioned in a matrix with two in a front row and two in a back row, it may be possible that each propulsion unit has three neighbours.

In order to avoid collisions the steering system according to the invention each separate control unit in the system is arranged to admit its propulsion unit to be positioned within a first angular interval if said second input signal(s) indicates that the position of respective neighbouring propulsion unit is known and admit its propulsion unit to be positioned within a second more restricted angular interval if said second input signal(s) indicates that the position of respective neighbouring propulsion unit is not known.

The invention ensures that collision between the neighbouring propulsion units may be avoided even if information from the control units associated with neighbouring propulsion units is lost or becomes insecure. Different strategies and types of second input signals may exist.

In a least elaborate embodiment, the second input signal may only contain information indicating that the steering control of the associated propulsion unit does not malfunction. In this event a complete steering strategy stored in the control unit can be maintained allowing operation within a first angular interval partly or wholly encompassing the common space. In this event the steering strategy stored in each of the control unit does not use the position of the other propulsion units as an input variable but relies on that the other units are acting properly as was intended when developing the strategy. A propulsion unit may be allowed to enter the common space under certain circumstances. For instance if the vessel makes a turn and the outer propulsion unit may be allowed to enter the common space since the inner propulsion unit should have reach a position for from the common space unless the steering of the inner propulsion unit is malfunctioning. The knowledge of whether the steering control does not malfunction, which is an indication of that the position is known, would be sufficient. In the event an indication of that the position is not known is deducted from the second input signal, the propulsion unit should not be allowed to enter the common space.

Another strategy would to inform the neighbouring propulsion units of whether the neighbouring propulsion units are inside the common space or not. In the event the neighbouring propulsion unit is within the common space entry into the common space can be denied for further units. In the event second input signal(s) indicates that the position of respective neighbouring propulsion unit is not known the propulsion unit controlled by the control unit which has received said second input signal shall be denied from entry into the common space. The propulsion unit may therefore positioned within a second angular interval where the propulsion unit does not enter said common space of the neighbouring propulsion unit(s).

A further strategy would be to let the second input signal represent the angular position of the neighbouring units. In the event this information is transmitted to neighbouring units it is possible to allow two neighbouring propulsion units to enter into the common space simultaneously as long as the units are separated sufficiently from each other in order to avoid collision. The allowable range for a propulsion unit would then be dependent on the position of the neighbouring propulsion unit. In the event the second input signal(s) indicates that the position of respective neighbouring propulsion unit is not known, the propulsion unit receiving said second input signal may not enter the common space of the neighbouring propulsion unit concerned.

Examples of indications that the position of a neighbouring propulsion unit is not known are as follows:

1) The signal may be lost.
2) The signal has not been updated within a predetermined period of time or within a predetermined number of action sequences. This type of indication requires that the second signal carries information of the status of the associated propulsion unit, which information according to what has been stated above may be any one or a combination of (OK—not OK, propulsion unit position, inside or outside of the common space), and a time or sequence mark showing whether the signal is up-to-date or not.
3) The signal value is outside of an allowable range.

The invention furthermore relates to a vessel including a steering control system of the type referred to above.

BRIEF DESCRIPTION OF DRAWINGS

The invention will be described in further detail below, with references to appended drawings where.

DETAILED DESCRIPTION

Figure 1:
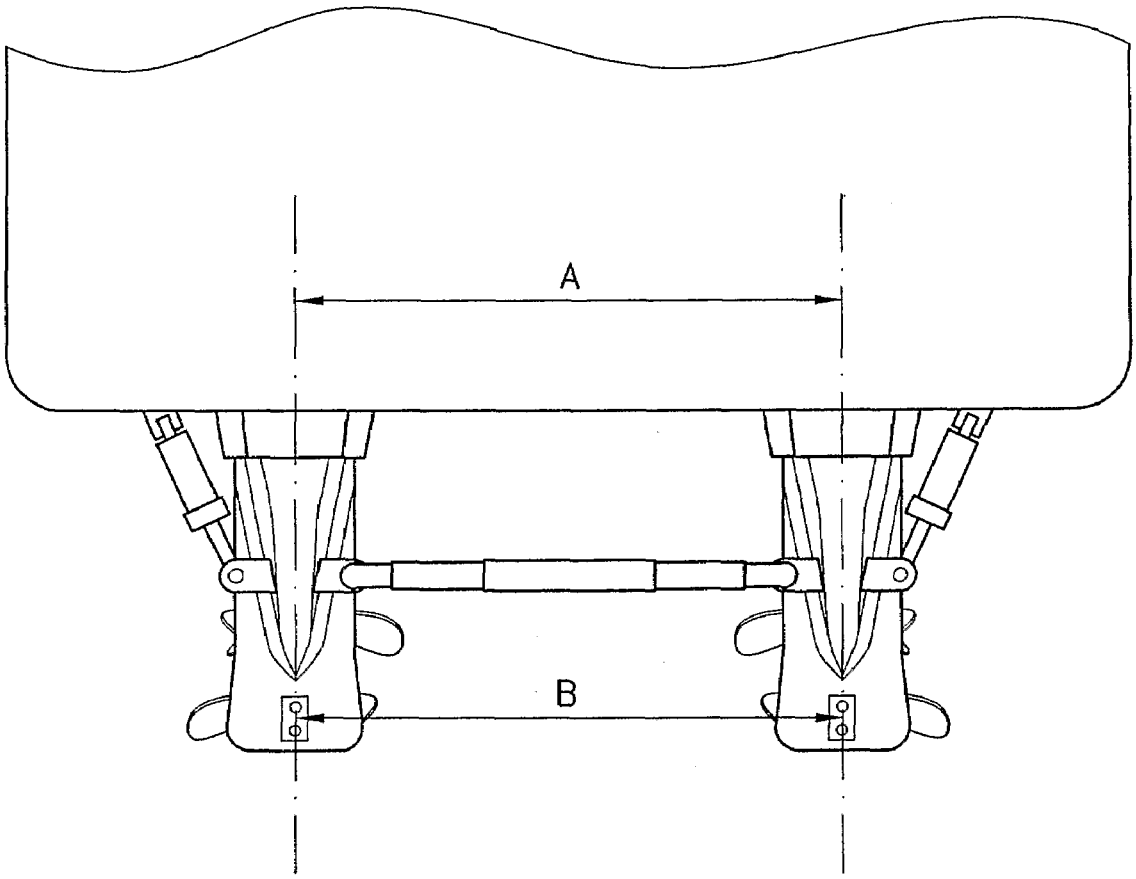
FIG. 1 Shows an example of a conventional mechanically linked set of propulsion units, FIG. 2 Schematically shows a vessel including a steering control system according to the invention.
Figure 2:
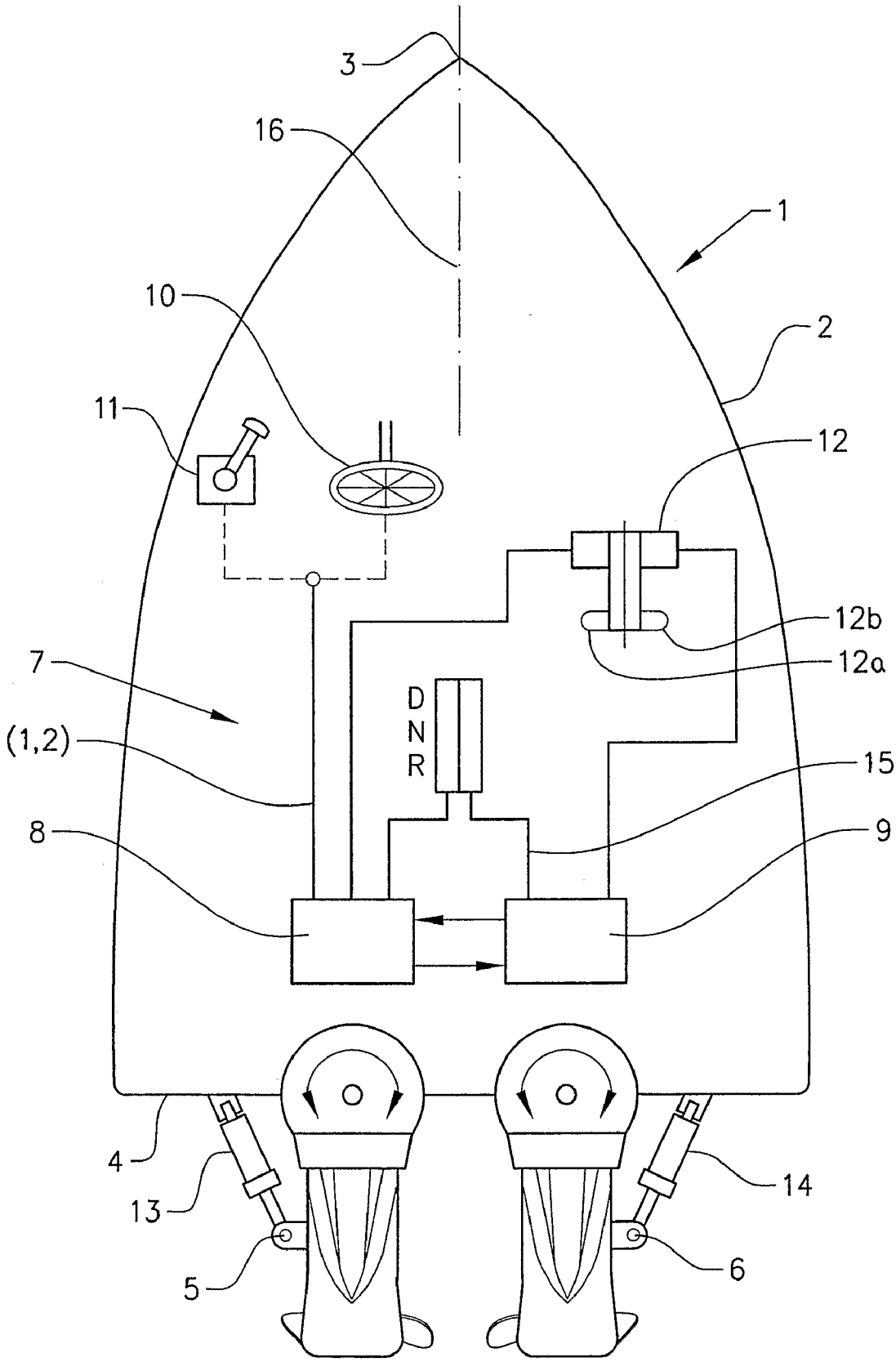

FIG. 2 shows a simplified top view of a vessel 1 in which the present invention can be used. Generally, the invention can be used in any type of vessel, such as larger commercial ships, smaller vessel such as leisure boats and other types of water vehicles or vessels. The invention is particularly useful for small leisure boats, but it is nevertheless not limited to such type of water vehicle only.

As indicated schematically in FIG. 2, the vessel 1 is designed with a hull 2 having a bow 3, a stern 4 and being divided into two symmetrical portions by a centre line 16. In the stern 4, two propulsion units 5, 6 are mounted. More precisely, the vessel 1 is provided with a first propulsion unit 5 arranged at the port side and a second propulsion unit 6 arranged at the starboard side.

The propulsion units 5, 6 are pivotally arranged in relation to said hull for generating a driving thrust in a desired direction of a generally conventional kind, for example in the form of an outboard drive, an azimuthal drive unit or out board engines.

The two propulsion units 5, 6 are independently steerable by a steering control system 7, which means that each propulsion unit is connected to and controllable by means of separate control units 8, 9 which are suitably in the form of a computerized unit for receiving commands from steering control instruments 10, 11. The steering control instruments may be provided in the form of a steering wheel 10 or a joy stick 11 or the combination of both. The separate control units furthermore receive input signals from a throttle lever 12 in a conventional manner. The throttling may be individually controlled by a lever for each propulsion unit or include a lever for each propulsion unit 12*a*, 12*b*. It is generally preferred to have two throttle levers one for each group of propulsion units positioned on the starboard side of the centre line and one for the group of propulsion units positioned on the port side of the centre line. The control units 8, 9 furthermore receives input signal from a gear selector which may engage respective propulsion unit in reverse, neutral or drive. Also here it is generally preferred to have two gear selector one for each group of propulsion units positioned on the starboard side of the centre line and one for the group of propulsion units positioned on the port side of the centre line. Such gear selector and throttle lever units are previously known as such, and for this reason they are not described in detail here. Based on received information from the steering control instruments 10, 11, the control units 8,9 are arranged to control the first propulsion unit 5 and the second propulsion unit 6 in a suitable manner to propel the vessel 1 with a requested direction and thrust.

The position of the propulsion units 5, 6 are individually controllable such that they may pivot and assume intended directions for generating a thrust in a desired direction independently of each other. Respective control unit controls actuator means 13, 14, which may for instance be constituted by a stepping motor or a hydraulic circuit. The control units 8,9 contains means for mapping an input signal from the steering control instruments into a reference value angle for respective propulsion unit 5, 6 where the actuator means are arranged to move the propulsion units such that they assumes the reference value angle. The mapping may be of simple type such that a steering angle is obtained from the steering control instruments and that the actuator means uses this input signal as the reference value angle. The mapping may also be more complex such that the reference value angles are calculated in dependence of the driving situation including speed, desired trim angle, whether docking is performed such that crabbing (movement in the sideways direction) of the vessel is desired and so forth.

In addition to the signals indicated above received by the control units, the control units furthermore receives second input signal(s) 15 originating from the other separate control units, associated with neighbouring propulsion units, which second input signal(s) indicating the status of the their associated propulsion units.

The propulsion unit is moveable within a working volume defined for each propulsion unit and wherein the working volume for neighbouring propulsion units of said at least two propulsion units have a common space. The working volume is the volume in space which may be occupied by a propulsion unit as is pivoted for steering purposes within an allowed angular range around the pivot axle. The common space is the common working volume that two neighbouring propulsion units may occupy. If the common space is used simultaneously, collision between the two units may occur.

The control units according to the invention are controlled such to admit its propulsion unit to be positioned within a first angular interval if said second input signal(s) indicates that the position of respective neighbouring propulsion unit is known and admit its propulsion unit to be positioned within a second angular interval where the propulsion unit does not enter said common space of the neighbouring propulsion unit(s) if said second input signal(s) indicates that the position of respective neighbouring propulsion unit is not known.

Figure 3A:
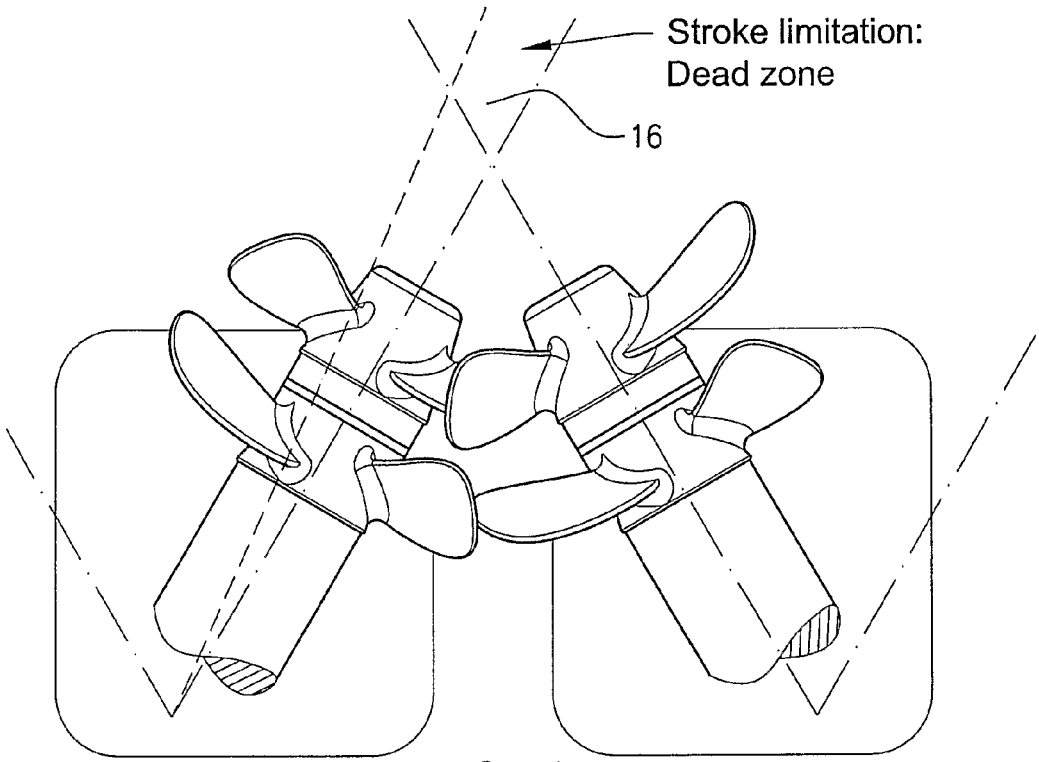
FIG. 3*a-c* Shows different sets of neighbouring propulsion units sharing a common space, and FIG. 4 Show a schematic example of a working volume.
Figure 3B:
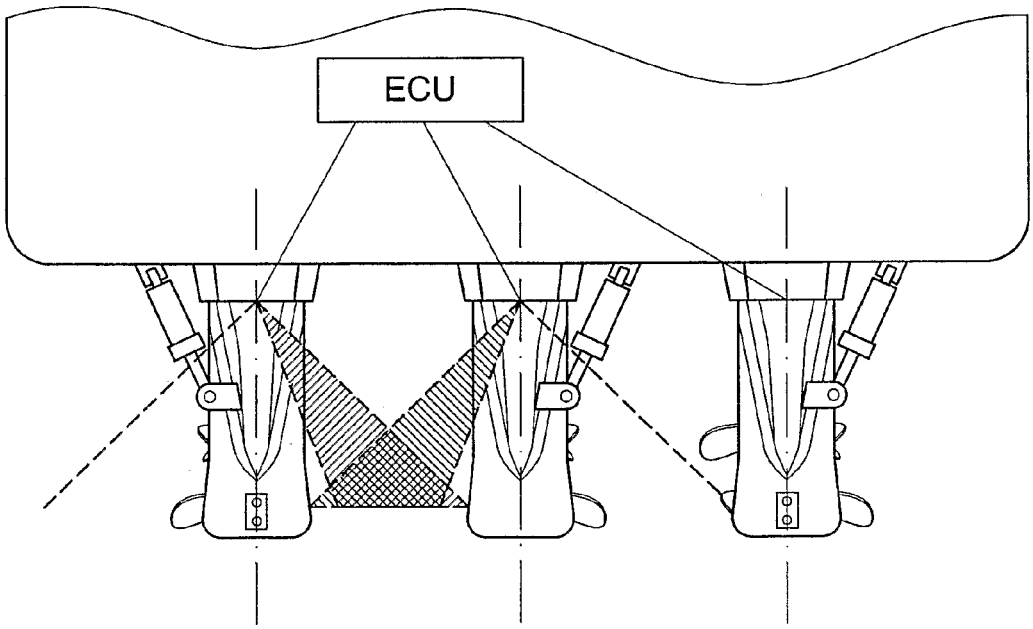
Figure 3C:
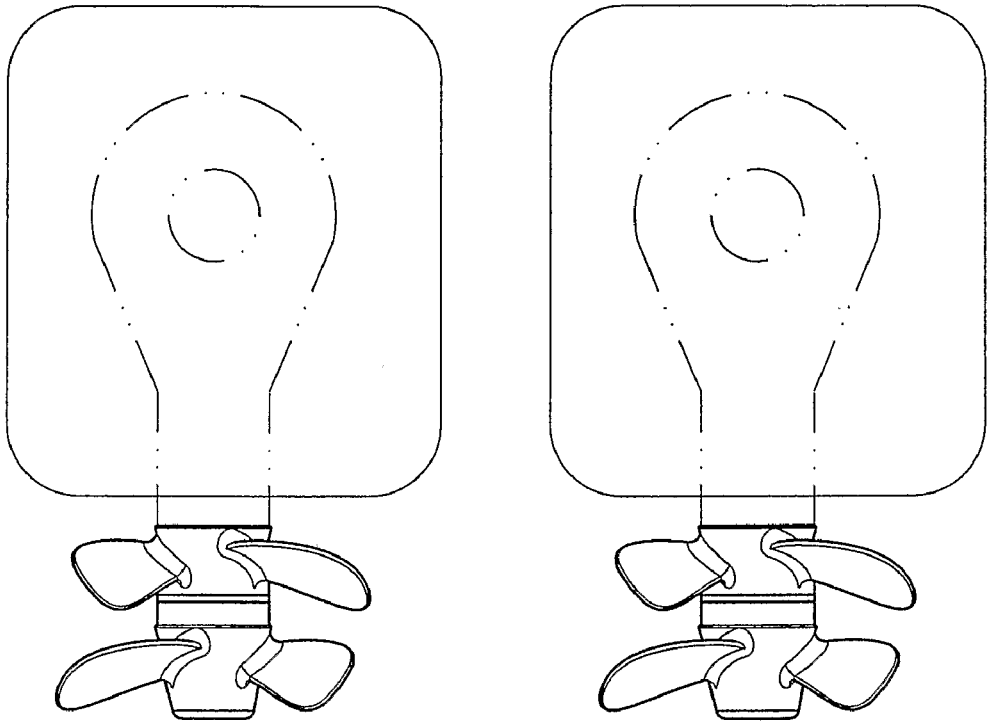

In FIGS. 3*a*-3*c* different sets of propusion units sharing a common space are shown. In FIG. 3*a* tow neighbouring drive units mounted under a vessel having propellers directed in the forward direction are shown. The propulsion units shares a common space 16 which may result in a collision in the event both propulsion units are pivoted to their respective most extreme angular position toward the centre line of the hull. In FIG. 3*b* three stem mounted drives share a common space 16 in pairs of two The starboard propulsion unit shares a common space with the centre propulsion unit and the port propulsion shares a common space with the centre propulsion unit on the other side of the centre propulsion unit. In the third example shown in FIG. 3*c* two out board engines share common spaces both if they turn toward or away from each other due to the geometrical configuration of the engines and due to the position of pivot axes for the engines. In all examples it is evident that all moving parts of the propulsion units must be included in the working volume. In the example shown in FIG. 3*c,* it is evident that the casings enclosing the engines of the out board propulsion units are moving and are positioned such that neighbouring casings may collide if the steering of each unit is not coordinated with the steering of a neighbouring unit.

Figure 4:
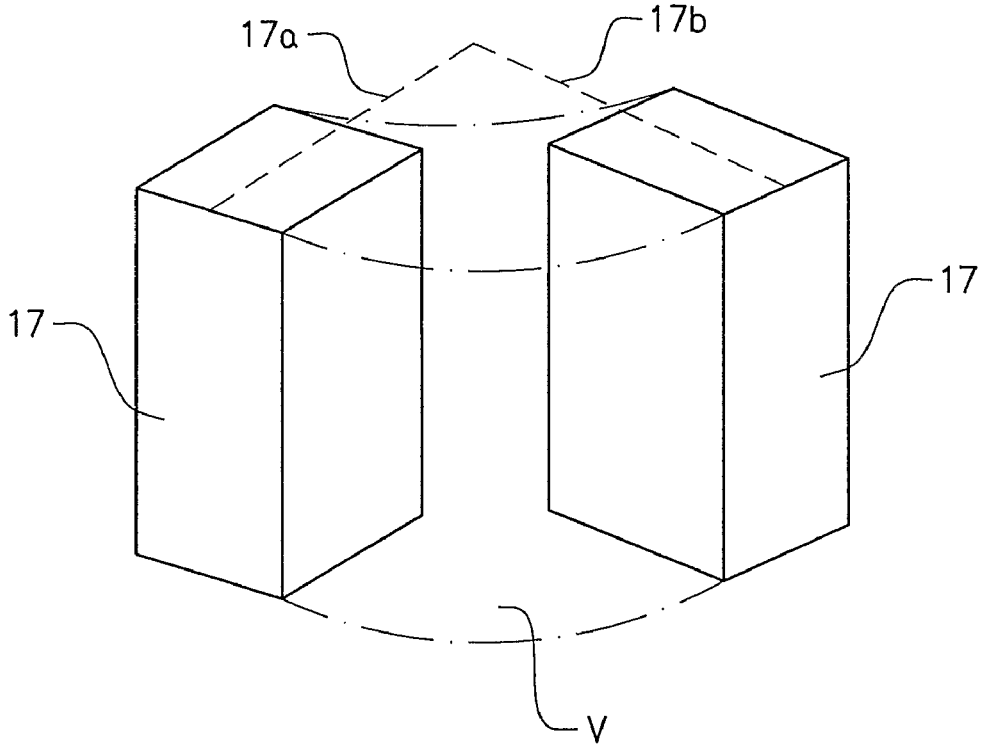

In FIG. 4 a schematic drawing of a working volume V is shown. The working volume V is defined by the swept volume of the drive unit 17, here simplified to a cuboid, moved from a first end position 17*a* to a second opposite end position 17*b,* which the drive unit may assume.

The invention claimed is:

1. Steering control system for a vessel including at least two propulsion units pivotally arranged in relation to the hull of the vessel for generating a driving thrust of the vessel in a desired direction, wherein each propulsion unit is moveable within a working volume defined for each propulsion unit and wherein the working volume for neighboring propulsion units of the at least two propulsion units have a common space, the control system including at least two separate control units each controlling an associated propulsion unit, and a steering control instrument for determining a desired angular position of the propulsion units, where each of the separate control units are arranged for receiving a first input signal from the steering control instrument for determining the desired angular position of its associated propulsion unit and second input signal(s) originating from the other separate control units, associated with neighboring propulsion units, which second input signal(s) indicating the status of the their associated propulsion units wherein each separate control unit is arranged to admit its propulsion unit to be positioned within a first angular interval if the second input signal(s) indicates that the position of respective neighboring propulsion unit is known and admit its propulsion unit to be positioned within a second angular interval where the propulsion unit does not enter the common space of the neighboring propulsion unit(s) if the second input signal(s) indicates that the position of respective neighboring propulsion unit is not known.

2. Steering control system according to claim 1, wherein the second signal corresponds to a verified actual position of the associated propulsion unit.

3. Steering control system according to claim 1, wherein the second signal corresponds to a verification of that the associated propulsion unit assumes its intended position.

4. Vessel including at least two propulsion units arranged for generating a driving thrust of the vessel in a desired direction, and a steering control system according to claim 1.

5. Method of operating a steering control system for a vessel including at least two propulsion units pivotally arranged in relation to the hull of the vessel for generating a driving thrust of the vessel in a desired direction, wherein each propulsion unit is movable within a working volume defined for each propulsion unit and wherein the working volume for neighboring propulsion units of the at least two propulsion units have a common space, the control system including at least two separate control units each controlling an associated propulsion unit, and a steering control instrument determining the desired angular position of the propulsion units, comprising receiving with the separate control units a first input signal from the steering control instrument and determining a desired angular position of the propulsion unit associated with the control unit and at least one second input signal originating from the other separate control units, associated with neighboring propulsion units, which second input signal indicating a status of the neighboring propulsion units, wherein each separate control unit admits its propulsion unit to be positioned within a first angular interval if the second input signal indicates that a position of respective neighboring propulsion unit is known and admits its propulsion unit to be positioned within a second angular interval where the propulsion unit does not enter the common space of the neighboring propulsion unit if the second input signal(s) indicates that the position of respective neighboring propulsion unit is not known.

* * * * *